US005184597A

United States Patent [19]

Chiuminatta et al.

[11] Patent Number: 5,184,597

[45] Date of Patent: Feb. 9, 1993

[54] APPARATUS AND METHOD FOR CUTTING UNHARDENED CONCRETE

[76] Inventors: Edward Chiuminatta; Alan R. Chiuminatta, both of 6677 Columbus St., Riverside, Calif. 92504

[21] Appl. No.: 516,060

[22] Filed: Apr. 27, 1990

[51] Int. Cl.[5] ..... B28D 1/04

[52] U.S. Cl. ..... 125/15; 51/206.4; 51/207

[58] Field of Search ..... 125/15, 13.01; 51/206 R, 206 P, 206.4, 206.5, 207; 299/39, 89, 79

[56] References Cited

U.S. PATENT DOCUMENTS

| | | | |
|---|---|---|---|
| 995,971 | 6/1911 | Keyes | 30/370 |
| 1,356,339 | 10/1920 | Clarke | 51/176 |
| 1,404,342 | 1/1922 | Clarke | 51/170 R |
| 1,488,912 | 4/1924 | Foerster | 125/22 |
| 1,614,225 | 1/1927 | Bath | 51/206 P |
| 1,731,872 | 10/1929 | Schons | 299/27 |
| 1,736,538 | 11/1929 | Kurtz | 299/27 |
| 1,866,356 | 12/1930 | Jones | 125/22 |
| 1,916,887 | 7/1933 | McClain . | |
| 2,032,395 | 3/1936 | Bley | 125/13.01 |
| 2,217,923 | 10/1940 | Silverman | 30/167 |
| 2,589,357 | 3/1952 | Fantozzi et al. | 125/15 |
| 2,688,347 | 9/1954 | Schmidt | 143/43 |
| 2,701,134 | 2/1955 | Klicpera | 262/20 |
| 2,949,068 | 8/1960 | Gresham | 94/45 |
| 2,996,089 | 8/1961 | McCarty | 143/68 |
| 3,106,661 | 1/1962 | Nielsen | 51/206 |
| 3,122,030 | 2/1964 | Metzger | 76/112 |
| 3,127,887 | 4/1964 | Meteger | 125/15 |
| 3,162,187 | 12/1964 | Christensen | 125/15 |
| 3,301,601 | 1/1967 | Zuzelo | 299/39 |
| 3,579,928 | 5/1971 | Held | 51/206 R |
| 3,599,622 | 8/1971 | Baron | 125/15 |
| 3,612,611 | 10/1971 | Ellis | 51/206.4 |
| 3,623,518 | 11/1971 | Nicotra | 143/43 A |
| 3,753,430 | 8/1973 | Oas | 125/14 |
| 3,775,529 | 11/1973 | Steenson et al. | 264/162 |
| 3,886,925 | 6/1976 | Regan | 125/15 |
| 3,910,711 | 10/1975 | Moorhead | 404/89 |
| 4,022,182 | 5/1977 | Lenkevich | 125/13.01 |
| 4,062,110 | 12/1977 | Alvarez | 30/90.8 |
| 4,188,934 | 2/1980 | Reinhardt et al. | 125/4 |

(List continued on next page.)

FOREIGN PATENT DOCUMENTS

| | | | |
|---|---|---|---|
| 0039024 | 4/1981 | European Pat. Off. . | |
| 0669364 | 12/1938 | Fed. Rep. of Germany | 125/15 |
| 1652523 | 12/1967 | Fed. Rep. of Germany . | |
| 0256366 | 10/1988 | Japan | 51/206.4 |
| 259124 | 4/1970 | U.S.S.R. . | |
| 278721 | 11/1970 | U.S.S.R. . | |
| 1135674 | 1/1985 | U.S.S.R. | 125/15 |

OTHER PUBLICATIONS

English Translation of Japanese Patent Laying-Open No. 63-256366 (Apr. 1987).

*Guide for Concrete Floor and Slab Construction,* American Concrete Institute, Detroit, Michigan, 1980.

*Primary Examiner*—Robert A. Rose

*Attorney, Agent, or Firm*—Knobbe, Martens, Olson & Bear

[57] ABSTRACT

A rotating cutting blade and its drive motor are mounted on a wheeled support platform. The blade extends through a skid plate depending from the platform, in order to cut the concrete below the skid plate. The slot in the skid plate has its ends configured to fit within predetermined distances of the corresponding ends of cutting segments on the cutting blade. The cutting segments are configured to have a generally inverted "T" configuration in which a central cutting segment extends radially outward from two cutting segments located on opposite sides of the central segment. The exterior edges of the cutting segments may be square or rounded. the juncture between the central and shoulder segments may be square or rounded. The concrete is advantageously cut before it hardens to 1200 psi, without the use of an added lubricant, or above that hardness with lubricant if the cutting plate is supported within a sufficiently close distance by a skid plate.

20 Claims, 5 Drawing Sheets

U.S. PATENT DOCUMENTS

| | | | |
|---|---|---|---|
| 4,267,814 | 5/1981 | Benson et al. | 125/15 |
| 4,397,089 | 8/1983 | Pease | 30/373 |
| 4,406,274 | 9/1983 | Ogyu | 125/13.01 |
| 4,416,842 | 11/1983 | Nash et al. | 264/145 |
| 4,456,303 | 6/1984 | Due | 299/10 |
| 4,483,071 | 11/1984 | te Kolsté | 30/376 |
| 4,505,251 | 3/1985 | Stoll | 125/15 |
| 4,516,560 | 5/1985 | Cruickshank | 51/206 R |
| 4,545,121 | 10/1985 | Arbruster et al. | 30/374 |
| 4,583,515 | 4/1986 | Ballenger | 125/15 |
| 4,739,745 | 4/1988 | Browning | 125/15 |
| 4,769,201 | 9/1988 | Chiuminatta et al. | 264/154 |
| 4,854,295 | 8/1989 | Sakarcan | 125/15 |
| 4,889,675 | 12/1989 | Chiuminatta et al. | 264/154 |
| 4,903,680 | 2/1990 | Chiuminatta et al. | 125/13.01 |
| 4,928,662 | 5/1990 | Chiuminatta et al. | 125/13.01 |
| 4,930,487 | 6/1990 | Younger | 125/15 |
| 4,938,201 | 7/1990 | Chiuminatta et al. | 125/13.01 |

APPARATUS AND METHOD FOR CUTTING UNHARDENED CONCRETE

BACKGROUND OF THE INVENTION

This invention relates to cutting concrete to prevent cracks.

Concrete is formed of a combination of a hydraulic cementing substance, aggregate, water, and, often other substances to impart specific properties to the concrete. When concrete is poured it is typically in a watery or flowing state which allows the concrete to be spread evenly over floors. After a period of time, varying with the mixture of the concrete, the temperature, and the moisture availability, the concrete attains a workable plasticity which permits the surface of the concrete to be formed and to retain a finish. Typical finishing means include troweling, rubbing, or brushing. Applying the desired surface texture is called "finishing" the concrete, and may involve repeated steps to sequentially refine the surface finish.

After the concrete is finished, it is allowed to stand for a period of time during which the concrete cures to obtain its well-known, rock-like hardness. The curing or setting time depends on the moisture available, the temperature, and the specific additives added to the concrete to affect the curing time. As the concrete cures it shrinks, which causes cracks. Thermal stresses from weather variations can also cause cracking.

It is common practice to provide slots or grooves at predetermined intervals in the concrete for crack control. Even if grooves are only on the surface of the concrete, the grooves cause the cracks to form along the bottom of the grooves so that they occur at regular intervals and are not visible. The grooves, but not the cracks, are visible. Of course the grooves must be put in the concrete soon enough or else all of the cracks will have already formed, and the grooves will be of no use.

U.S. Pat. Nos. 4,889,675 and 4,769,201, both to Chiuminatta, et. al., discuss a method of cutting uncured concrete by in part, controlling the spacing between a rotating concrete cutting blade and the adjacent sides of a skid plate. Using the method of cutting described in these Chiuminatta patents, a common specification for cutting grooves is to cut them $\frac{5}{8}$ to 1 inch deep, and about 0.1 inch wide, with the cutting occurring within a few hours after the concrete is finished.

The crack control grooves may also function as contraction joints. Typically, a slab of concrete is at its largest size when it is poured, and it shrinks or contracts thereafter As the concrete shrinks, the slabs of concrete on each side of the groove contract and the grooves widen. When the temperature rises, the grooves may partially close. Since the grooves accommodate the contraction of the concrete, they are called contraction joints even though the grooves themselves sometimes spread apart, or expand.

In outdoor applications it is common practice to seal these contraction joints by sealing the grooves with tar or other sealants. The sealants prevent water from entering the cracks at the bottom of the grooves, soaking through to the bottom of the concrete, and creating a weakened spot in the foundation, or even washing away the foundation of the concrete. Moisture freezing in the cracks can also gradually widen the cracks. The sealants can only stretch a limited amount, and thus can accommodate only a limited amount of widening of the grooves before the sealants pull away from the sides of the grooves and allow moisture to pass into the groves and cracks. Currently, a sealant segment about 0.25 inches 0.635 cm.) square is needed to accommodate the width changes which occur in the grooves, with some sealant suppliers preferring about 0.375 inches (0.9525 cm.) square or more of sealant.

Since the crack control grooves are typically much smaller, on the order of 0.09 inches (0.020574 cm.), a larger and shallower groove, called a "well," is cut into the top of the crack control grooves and sealant placed into the well. The groove forming the well for the sealant is typically 0.25×0.25 inches, or 0.375×0.375 inches.

Conventional practice has been to cut crack control grooves in the concrete as soon as possible, and about 7 days later, to use diamond abrasive water saws to cut over the crack control grooves and form a wider, shallower well into which the sealant is placed. Since the sealant well is so much wider than the crack control grooves, the concrete must be allowed to become very hard to avoid cracking, chipping, and spalling of the concrete when the 0.25 or 0.375 inch wide groove is cut to form the well for the sealant. Thus, the seven day delay is often required to insure the concrete is sufficiently hard and will not crack, chip, or spall when the wide groove for the sealant well is cut in the surface of the concrete.

It is very costly and time consuming to cut these grooves for the sealant so long after the concrete is poured, as it requires sending workers back to locations which are often far away from where the main work force is then employed. Moreover, the water abrasive saws are bulky and heavy, weigh 900 pounds or more, and require a water source and water hoses to lubricate the saw. The cutting also splatters a lot of concrete mud and water, and causes a time consuming cleanup.

The slurry created by the water lubricated saws also imbeds particles in the sides of the cut groove which prevent the sealant from properly sealing. Thus, it is common practice to sandblast the cut grooves to remove this imbedded slurry. The extra time, labor, and equipment are again expensive and cumbersome to provide.

There is thus a need for an improved method and apparatus to cut concrete and form crack control grooves, and to cut grooves to form wells for sealants. There is a further need for cutting such grooves with the least time and labor necessary, while still producing grooves of acceptable, if not superior, surface finish by providing grooves without any cracking, spalling, or chipping along the edges of the groove. There is a further need to provide a smaller and lightweight way to cut these wells for the sealants, and to do so without the water connections, water consumption, sandblasting, and mess associated with conventional, diamond abrasive water saws.

SUMMARY OF THE INVENTION

An apparatus is provided for cutting a groove in uncured concrete. The apparatus can cut the concrete anytime after the concrete is finished and before the concrete attains its rock like hardness, and is preferably used before the concrete has shrunk sufficiently to cause cracking along planes other than those planes defined by the cut grooves.

The concrete saw has a base plate on which are mounted a plurality of wheels and a removable skid plate to support the saw on the concrete. A motor is pivotally mounted on the base plate. The motor drives a circular saw blade with an up cut rotation. The saw blade extends through a slot in the skid plate, in order to project into and cut the concrete below the skid plate. A handle is pivotally attached to the saw to shove the saw across a large slab of concrete.

A cutting blade is used which has a multi-level cutting surface to simultaneously cut a crack control groove and a shallower and wider groove to contain sealant. The cutting blades have a generally inverted "T" cross-section and form a groove having a generally "T" shaped cross-sectioned configuration.

The dimensions of the slot in the skid plate are selected to support the concrete immediately adjacent the multi-level profile of the cutting blade so as to prevent cracking, chipping and spalling of the concrete as it is cut.

Specifically, there is provided a circular concrete saw blade comprising a support disc having a cutting surface about the periphery of the disc. The cutting surface comprises a central convex cutting surface, and side convex cutting surfaces located on opposite sides of the central cutting surface and radially inward from the central cutting surface.

In one embodiment, the juncture between the central cutting surface and each side cutting surface is comprised at least in part by substantially straight lines. In another embodiment, the juncture between the central cutting surface and each side cutting surface is concave. In some embodiments, the exterior cutting surfaces have rounded edges, while in others, the exterior edges are substantially square.

There are also variations on the shape of the cutting surfaces, as one embodiment comprises a plurality of cutting surfaces with circumferentially leading and trailing ends forming a wedge shape in which the axial width of the leading end is smaller than the axial width of the trailing end. An axial width on the trailing end of the central cutting segment which is about 35–45% larger than the axial width of the leading end is believed advantageous. In another embodiment, the cutting surfaces comprise a plurality of spaced-apart cutting segments supported about the periphery of the support disc, where a plurality of the cutting segments have leading and trailing ends forming a wedge shape in which the height of the leading end is smaller than the height of the trailing end.

In yet another embodiment, the cutting surface comprises cutting segments formed by a plurality of outwardly extending slots which extend through the axial width of the support disc or cutting segment. In a variation of this embodiment, the cutting segments are formed by a plurality of outwardly extending slots which extend partially through the axial width of the support disc or cutting segment.

While it is preferable that the cutting surfaces be located on a single support, and be integrally formed of a single, suitable cutting material, in an alternate embodiment each of the central and side cutting surfaces are located on separate support discs.

Advantageously, the central cutting surface extends radially beyond the side cutting surfaces by about 0.1 to 1.0 inches More advantageously, the central cutting surface extends radially beyond the side cutting surfaces by about 0.1 to 0.5 inches. For some uses, it is believed that the central cutting surface should extend radially beyond the side cutting surfaces by about 0.05 to 0.2 inches. The most advantageous configuration is currently believed to be where the central cutting surface extends radially beyond the side cutting surfaces by about 0.2–0.5 inches, and where the central cutting surface has a diameter of about 4.75 to 6 inches.

The cutting surfaces may also be viewed as comprising discrete cutting segments as described above Alternatively, the cutting blade may be described as comprising a first cutting means for cutting a first groove in the concrete at a first depth, and a second cutting means for cutting a second groove in the concrete, where the depth of the second groove is less than the depth of the first groove, and the width of the second groove is wider than the width of the first groove.

Advantageously, the first cutting means is configured to cut the first groove to a depth corresponding to between 0.5 to 1.1 times the size of the maximum aggregate in the concrete, and the depth and width of the second groove is selected to hold a sufficient amount of sealant to maintain the sealant in contact with sides of the second groove during climatic variations when the sealant is placed in the second groove. Advantageously, these criteria are met by using concrete cutting blades which are between 3.5 and 6.0 inches in diameter. If larger blades are used, then larger motors and other equipment are required, which make the saw too heavy to use on freshly finished concrete.

The cutting blades of this invention also comprise a new method of cutting grooves in a concrete surface which has been poured and finished, but which is uncured. This method comprises the steps of rotating a cutting blade in an up-cut rotation in the concrete surface to form a groove having a bottom interior to the concrete surface with a first width and depth sufficient for crack control, and having a top opening onto the concrete surface with a second width sufficient to hold enough concrete sealant to maintain sealing contact with sides of the groove during climatic variations.

In an alternate method, the steps comprise cutting a first crack control groove in the concrete by using a rotating cutting blade having an up-cut rotation, where the crack control groove has a first width and depth sufficient for crack control, and simultaneously cutting a second groove in the concrete which is substantially parallel to and overlaps the first groove and opens onto the surface of the concrete. The depth of the second groove is less than the depth of the first groove and holds a sufficient amount of concrete sealant to maintain sealing contact with sides of the second groove during climatic variations.

The steps of both methods are performed before the concrete has hardened to 2000 psi, and advantageously before the concrete has hardened to 1200 psi. Advantageously, the cutting steps are performed by the above described cutting blades.

In an alternate embodiment an additional step is added, where the concrete surface is supported adjacent the surfaces of the cutting segments at a leading edge of the cutting blade at a distance sufficiently close to the cutting segments to produce an acceptable surface adjacent the groove which does not crack, chip or spall. Advantageously, a similar supporting step at the trailing edge of the cutting blade is also used.

In a further embodiment of this invention using lubrication, the concrete is allowed to harden sufficiently so the hydraulic force from the lubrication of the cutting blade does not cause the groove to erode or the surface of the concrete to erode so as to produce an unacceptable surface finish adjacent the groove. The appropriate hardness is believed to be about 1200 psi, and preferably about 2000 psi. The concrete is then cut with the above steps, but with the additional step of lubricating the cutting blade during the cutting steps. In a variation of this embodiment, the cutting steps are performed by a down-cut rotating blade.

The skid plate used in the above method, and advantageously used with the above cutting blades, comprises a skid plate with a leading end, a trailing end, and a first longitudinal slot through the skid plate, with the first slot having a leading end and a trailing end. The leading end of the slot has a width selected so that the sides of the slot are about 0.25 inch from the sides of an cutting segment of a cutting blade extending through the slot. The leading end of the first slot has a second longitudinal slot centrally located therein, with the second slot being aligned with the first slot and extending toward the leading end of the skid plate. The width of the second slot is selected so the sides of the slot are about 0.25 inches from the sides of an cutting segment of a cutting blade extending through the second slot. The first slot is at least two times the axial width of the cutting segment extending through the second slot.

Advantageously, the trailing end of the first slot is similarly constructed. More advantageously, the first slot has a closed end which contacts the concrete surface during cutting. It is more advantageous to have the above dimensions be smaller, thus it is more advantageous to have the spacings within about 0.125 inches of the sides of the cutting segments extending through the respective slots, and even more advantageous to have the sides of the slots within about 0.06 inches of the sides of the cutting segments extending through the respective slots.

The spacing between the peripheral, circumferential edges of the cutting blades and the adjacent ends of the slots are also advantageously selected so the ends of the first, second, and third slots end about 0.5 inches from the circumferential ends of the cutting segment extending into the respective slots during use of the skid plate. Advantageously, this spacing is about 0.25 inches, and more advantageously, is about 0.125 inches from the circumferential ends of the cutting segments extending into the respective slots during use of the skid plate.

DESCRIPTION OF THE DRAWINGS

The present invention will be better understood from the description of the preferred embodiment which is given below, taken in conjunction with the drawings (like reference characters or numbers refer to like parts throughout the description), and in which.

DESCRIPTION OF THE PREFERRED EMBODIMENT

Figure 1:
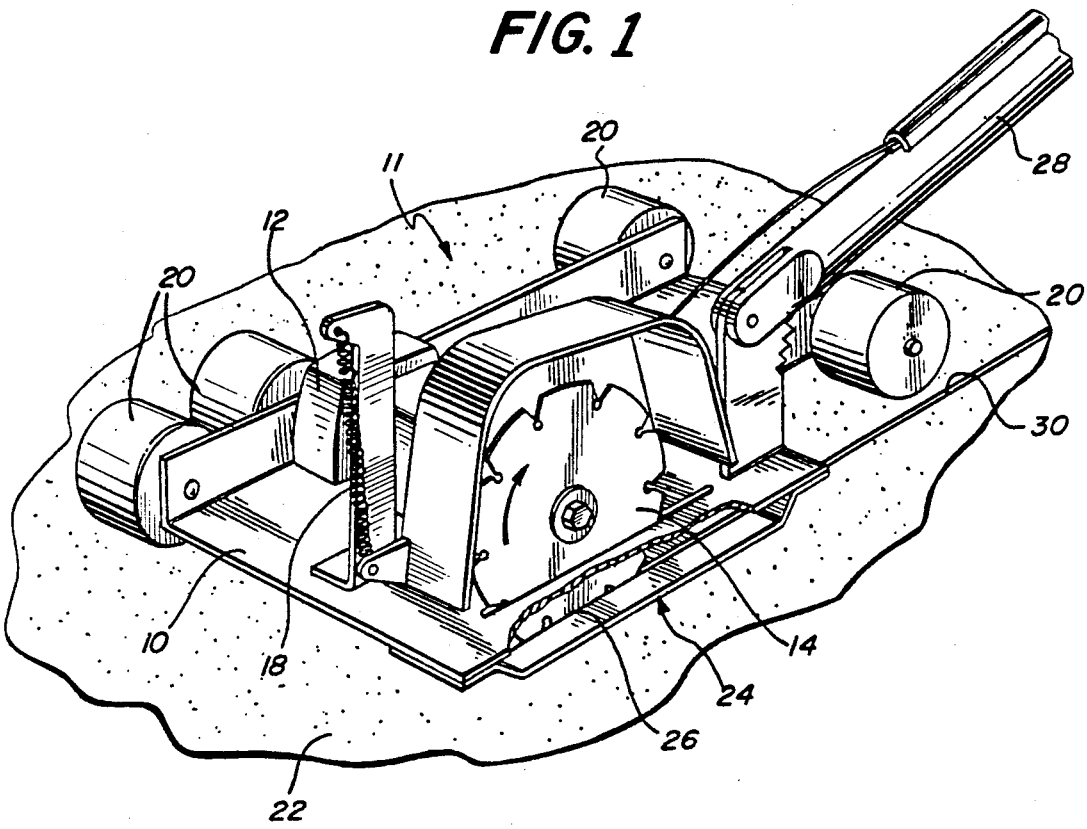
FIG. 1 is an elevated perspective view of the saw of this invention being operated in the middle of a slab of concrete.
Figure 2:
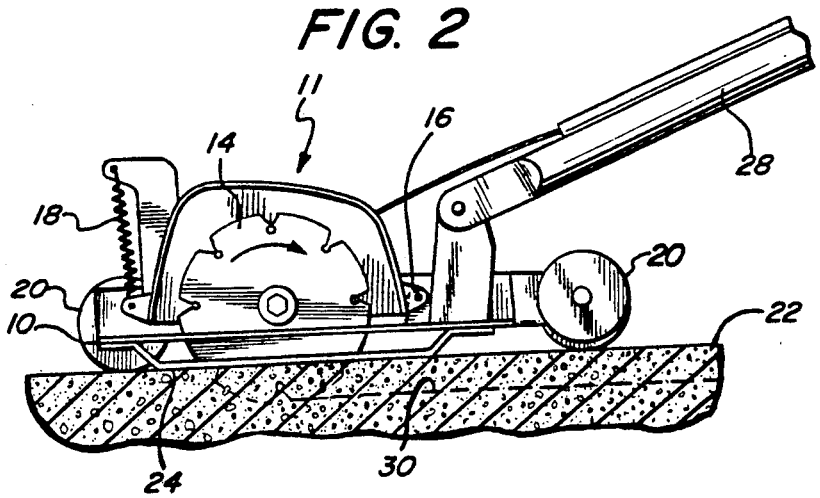
FIG. 2 is a side view of the saw of this invention showing the motor and blade in a lowered, cutting position.

Referring to FIGS. 1 and 2, a saw 11 for cutting uncured concrete is shown. The term "uncured" means concrete which is not completely cured to its rock-like hardness; it means concrete which has a hardness less than about 2000 pounds per square inch ("psi"), and preferably has a hardness less than about 1200 psi, as measured using a Swiss Hammer.

Saw 11 comprises a support plate 10 on which is mounted a motor 12 which drives a rotating cutting blade 14. The motor 12 and cutting blade 14 are pivotally mounted to the support 10 by a pivot 16 (FIG. 2). A resilient member such as spring 18 urges the motor 12 and blade 14 away from the support 10.

A plurality of wheels 20 support the saw 11 on a concrete surface 22 and allow the saw 20 to roll across the surface 22. A skid plate 24 is removably connected to the support 10, and depends sufficiently to slide on the surface of the concrete 22. The skid plate 24 has a longitudinal slot 26 extending through it, with the blade 14 extending through the slot 26 to cut the concrete 22. A handle 28 connects to the support 10 to allow the saw 11 to be pushed and guided across the surface of the concrete 22.

The blade 14 rotates in an up-cut direction to cut grooves 30 in the concrete 22, with the spring 18 and pivot 16 allowing the blade 14 to float or move out of the surface of the concrete 22 when rocks or aggregate are encountered by the blade 14. A visual depth indicator (not shown) shows the depth of the groove 30 cut by the blade 14. The depth indicator shows the depth of the groove 30 relative to predetermined limits, and then the saw 11 is pushed either faster or slower across the concrete 22 to maintain the depth of cut at the predetermined depth, as indicated by the depth indicator 31.

The spacing between the blade 14 and the adjacent sides of the slot 26 in skid plate 24 are controlled to provide an acceptable surface finish on the concrete surface 22 adjacent the sides of the groove 30. Preferably, the spacing is as small as possible without binding the blade 14. The saw 11 operates without a lubricant, unlike conventional diamond abrasive water saws.

A more detailed explanation of an earlier version of the saw 11 and an explanation of some of the spacing and hardness figures for that earlier version may be found in U.S. Pat. Nos. 4,889,675 and 4,769,201, to Chiuminatta, et. al.

A blade 14 about 5 inches in diameter and 0.25 inches wide was used with the saw 11 to cut a deep crack control groove 30, with the width being sufficiently wide to also function as a well to hold sealant. This blade 14 is about three times wider than the 0.09 inch thick blades used for crack control. The increased blade width results in much more material being removed from the concrete slab to form the grooves 30. The result is that the cutting of the contraction groove in the uncured concrete goes much slower than cutting the grooves for crack control.

Figure 3:
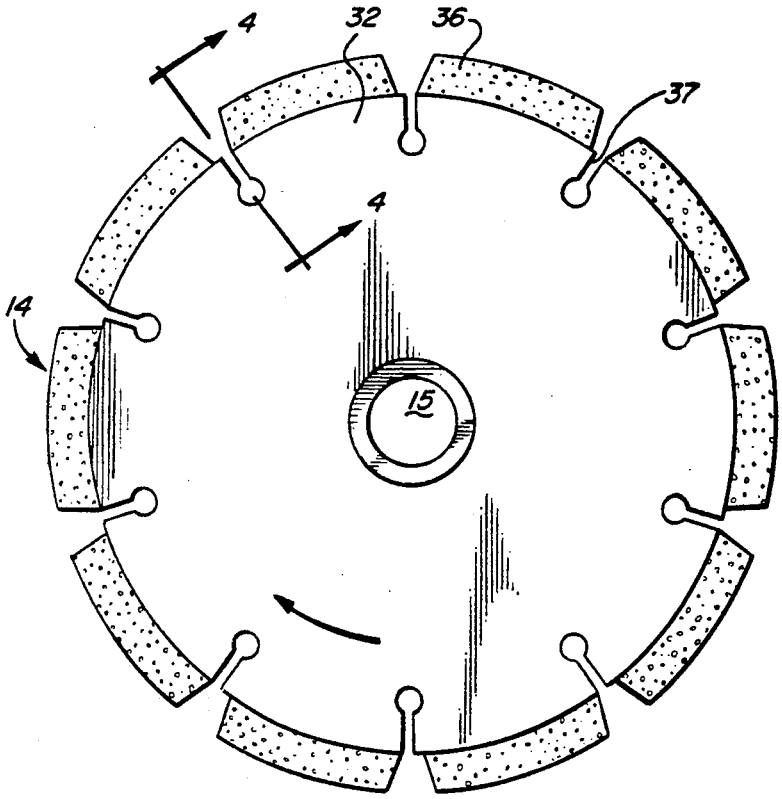
FIG. 3 is a side view of a cutting blade having a large rectangular cutting segment about the periphery of the blade.
Figure 4:
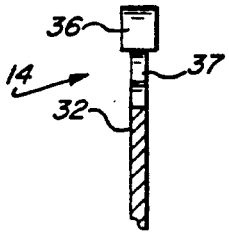
FIG. 4 is a partial sectional view taken along lines 4—4 of FIG. 3 showing the cross-sectional shape of the cutting segment.

The concrete cutting blade 14 used to cut the contraction joint in uncured concrete is shown in FIGS. 3 and 4. The blade 14 has a circular support 32 comprising a metal disc with a hole 15 (See FIG. 3) in the center for mounting onto a drive shaft of the motor 12 (FIG. 1). The term "radially outward" refers to the radial direction in the plane of the cutting blade and away from the center of the hole in the cutting blade. The term "radially inward" refers to the radial direction which is in the plane of the cutting blade and toward the center of the hole in the cutting blade.

The support disc 32 is about 0.125 inches thick along the axis of rotation of the blade 14. A plurality of cutting segments 36 are circumferentially spaced around the periphery of the support 32. The segments have a cross-sectional area of about 0.25 inch height in a radial direction, and a uniform width in an axial direction of about 0.25 inch along the peripheral length of each segment, when the blade 14 is new. "Axial" refers to the direction parallel to the rotational axis of the disc.

The segments 36 are separated by radial slots 37 extending a short distance radially inward. The slots 37 help carry concrete out of the groove 30 as the groove is cut. The diameter of the blade 14 is around 5 inches The segments 36 are made of a diamond and metal matrix, although other combinations of cutting materials are available. The segments 36 are substantially more resistant to abrasion by the concrete 22 than the support disc 32.

Figure 5:
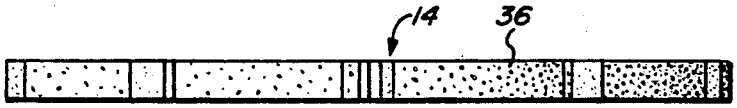
FIG. 5 is a top plan view of the cutting blade of FIG. 3.

As the blade 14 shown in FIGS. 3–5 is used, the segments 36 maintain the rectangular shape and uniform axial width, but the height of the segments 36 in the radial direction decrease as the segments wear. The same is true for blades 14 having smaller cutting segments 36 suitable for cutting crack control grooves. The cutting speed on a blade 14 of this type, when cutting a groove 30 (FIG. 1) deep enough for crack control and wide enough to hold sealant, is about 3 feet per minute (about 0.9 meters per minute). That rate is much slower than the cutting rate for water lubricated abrasive saws, yet the advantages of being able to cut so soon after finishing are so great that the cutting blade is still much requested. Unfortunately, the blade of FIGS. 3–5 does not produce suitable results when the aggregate in the concrete 22 is very hard. The blades described hereinafter are believed to cut at over twice the rate as the blade of FIG. 4, and are believed suitable for use with hard aggregate.

Figure 6:
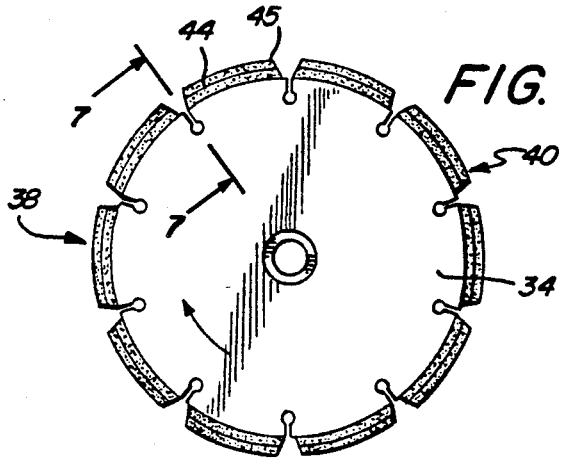
FIG. 6 is a side plan view of an embodiment of a cutting blade of this invention.
Figure 7:
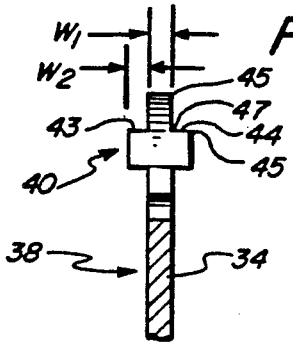
FIG. 7 is a partial sectional view taken from 7—7 of FIG. 6, and showing the cross-sectional shape of a cutting segment of this invention.

Referring to FIGS. 6–7, a cutting blade 38 comprises a plurality of cutting segments 40 having a uniform cross-sectional shape, which will be referred to as an inverted "T" shape, where the stem of the "T" extends radially outward. The segments 40 each comprise a radially extending center portion 42 having a generally rectangular cross-sectional shape which forms the stem of the "T." Two shoulder portions 43 and 44 are located on opposite sides of the center portion 42, with each of the shoulder portions 43 and 44 having a generally rectangular shape with square exterior edges 45.

Figure 9:
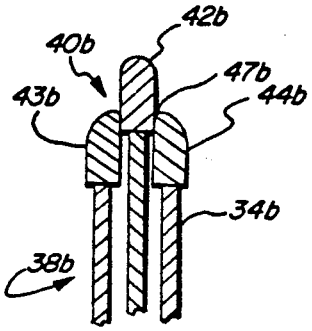
FIG. 9 is a sectional view taken along lines 9—9 of FIG. 11, showing the cross-sectional shape of a trailing end of a cutting segment of this invention.

The "exterior edges" refer to the edges which extend outward from the cutting blade, or are at the outer portion of a convex protrusion on the blade. Edges 45 in FIGS. 7 and 9 illustrate such exterior edges. "Interior edges" refer to the edges which extend inward toward the cutting blade, or are at the inner portion of a concave protrusion on the blade. Edges 47 in FIGS. 7 and 9 illustrate such interior edges.

The segments 40 are mounted on the support disc 34, and overhang, or extend axially beyond, each exterior side of the disc 34. The segments 40 should have an axial width sufficiently greater than the axial width of the support disc 34 to prevent undercutting and unacceptable abrasion of the support disc 34. The amount of difference in axial width that is needed to prevent this undercutting will vary with the design of the blade 38. An overhang of about 1/64 of an inch 0.015625 in. or 0.0397 cm.) is believed suitable.

For the illustrated embodiment, used to cut a groove (FIG. 1) that is about 0.25 inch wide, the axial width $w_1$ of the shoulders 43 and 44 is about equal to the axial width $w_2$ of the central portion 42 which are about 0.085 inches 0.2159 cm.) wide. The dimension of the central portion 42 radially outward from the sides or shoulders 43 and 44 is about 0.25 inch. The radial dimension of the shoulders 43 and 44 is also about 0.25 inch. The height and axial width of the segments 42, 43, and 44 are uniform along the peripheral length of the segment 40.

Figure 8:
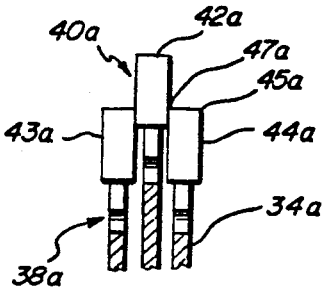
FIG. 8 is a sectional view showing the shape of an embodiment of a cutting blade of this invention.

A cutting blade **38*a* having a cutting segment configuration similar to that of FIG. 7 was tested, and is shown in FIG. 8. Three separate blades 14 were placed on a single shaft, where the two exterior blades were 4.5 inches (11.43 cm.) in diameter, and the center blade was 5 inches (12.7 cm.) in diameter. The individual blades had cutting segments 42*a*, 43*a*, and 44*a* which were each about 0.09 inches wide, and about 0.25 inches in the radial direction. The amount by which the shoulders 43***a* and 44*a* overhung the support disc 34*a* was about 1/64 of an inch. There was a slight overlap between the cutting segments of the individual blades, with the radially outer edge of the cutting segment of shoulders 43*a* and 44*a* abutting the radially inner edges of the cutting segment of central blade 42*a*.

The test was run by cutting grooves in a concrete slab about 32 feet long where the hardness of the concrete slab was under 1200 psi. The blade was inspected between cuts, and the time it took to make each of the cuts was noted. When the blade 38*a* of FIG. 8 was tested by cutting to a depth suitable for crack control, its cutting rate began at an unexpectedly high rate of about 4.8 feet per minute for the first 32 feet of cutting grooves in concrete, increased to almost 7 feet per minute after cutting about 160 feet of grooves in the uncured concrete, and increased to almost 9 feet per minute as after cutting about 290 feet of grooves in the uncured concrete.

The increase in cutting speed as more concrete was cut, was not linear. The initial cutting speed is notably and unexpectedly faster than the cutting speed for the rectangular blade shown in FIG. 4, which speed was tested at about 2.8 feet per minute when cutting to a depth suitable for crack control.

Figure 10:
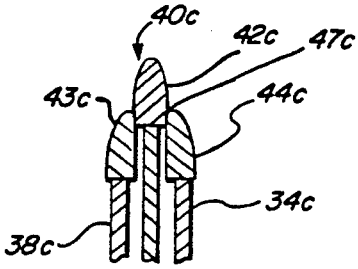
FIG. 10 is a sectional view taken along lines 10—10 of FIG. 11, showing the cross-sectional shape of a leading end of a cutting segment of this invention.
Figure 11:
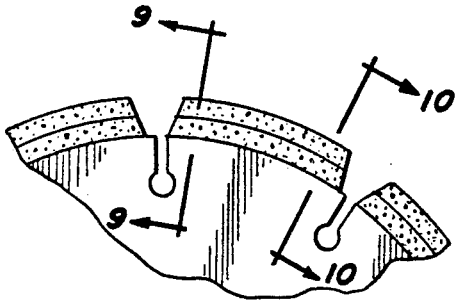
FIG. 11 is a partial sectional view showing a cutting segment of a cutting blade of this invention.

As the cutting blade 38*a* of FIG. 8 was used, its shape changed to a shape generally shown in FIGS. 9–10. The previously square exterior edges of the cutting segments 42*a*, 43*a*, and 44*a* became rounded, and the circumferentially leading end of the cutting segments 40*a* (FIG. 10) became narrower than the trailing end (FIG. 9). The "leading end" refers to the end of the cutting blade or cutting segment which leads in the direction of rotation of the cutting blade during use. The "trailing end" refers to the end which is located in the direction opposite to the direction of rotation of the cutting blade during use.

The cutting segments of blade 38*a* assumed a slight wedge shape from the circumferential leading end toward the circumferential trailing end, at what is believed to be a uniform rate of change from the leading to the trailing end. The amount of the dimensional difference in the axial direction was small, about 1/64 of an inch between the leading and trailing end of each individual segment of the blades 43*a*, and 44*a*, but that amounted to about a 20% change in axial width of each individual blade portion 43*a* and 44*a*.

The center cutting segment 42*a* became domed, or convex, with a generally symmetrically rounded top as shown by segments 42*b* and 42*c*. The side or shoulder segments 43*a* and 44*a* became rounded or convex as in 43*b*, 43*c*, 44*b*, and 44*c*. The convex shapes were not symmetric, as the exterior edges 45 were more rounded, with only a slight rounding on the interior edges 47 adjacent the sides of the cutting segments 43*b*, 43*c*, 44*b*, and 44*c* abutting the center blade 42*b* and 42*c*. The outer surface of the shoulder segments 43*b*, 43*c*, 44*b*, and 44*c* extended in a curve from the sides adjacent the center blade 42*b* and 42*c*, to the outer, exterior sides of the cutting blades 43*b*, 43*c*, 44*b*, and 44*c*. The cutting speeds increased perceptibly as the square exterior corners 45 of the cutting segments 42*a*, 43*a*, and 44*a* became rounded as in 42*b*, 42*c*, 43*b*, 43*c*, 44*b*, and 44*c*.

As the cutting segments 40*a* of FIG. 8 generally maintained the rounded configuration during cutting, it is believed that a cutting blade 38, formed to have cutting segments 40*b*, 40*c* with rounded exterior edges to begin with, like those shown in FIGS. 9 and 10, would not only cut at higher rates from the first use of the cutting blade, but would also maintain the same general shape throughout the life of the cutting blade. Similarly, it is believed that a cutting blade 38 made so that its cutting segments 40*b*, 40*c*, tapered to a generally wedge shape, narrower at the circumferential leading end and wider at the circumferential trailing end as shown in FIGS. 9 and 10, would also cut faster from the start, and maintain the same general wedge shape during cutting.

Figure 12:
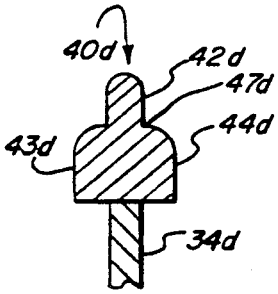
FIG. 12 is a partial sectional view showing the cross-sectional shape of a cutting segment of this invention.
Figure 13:
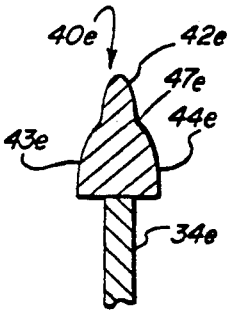
FIG. 13 is a partial sectional view showing the cross-sectional shape of a cutting segment of this invention.

FIGS. 12 and 13 show variations on such cutting blades made with rounded or convex exterior corners. FIG. 12 shows the shoulder blades or side cutting segments 43*d* and 44*d* as having rounded exterior edges, and a domed center cutting segment 42*d* which extends radially outward from the juncture with the side or shoulder cutting segments 43*d* and 44*d*. In FIG. 12, the interior juncture 47*d* between the shoulder segments 43*d* and 44*d* and the center segment 42*d* is substantially perpendicular, or at a slight acutely angled curve.

In the embodiment of FIG. 13 the interior juncture 47*e* is a curved concave transition, or may be described as an obtusely angled curved transition. The juncture 47*d* in FIG. 12 may be viewed as a concave transition, but not as a smoothly curved transition.

Figure 14:
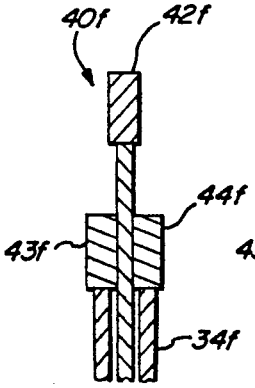
FIG. 14 is a partial sectional view showing the cross-sectional shape of a cutting segment of this invention.
Figure 15:
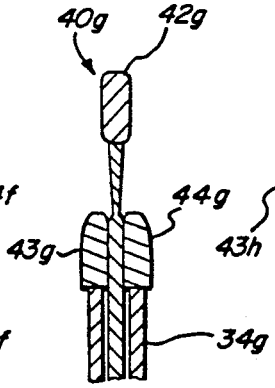
FIG. 15 is a partial sectional view showing the cross-sectional shape of a cutting segment of this invention after use.

Referring to FIGS. 14 and 15, the height of the center portion 42*f* of the cutting segment relative to the shoulders 43*f* and 44*f* also affects the cutting. In FIG. 14, two 4 inch diameter shoulder blades 43*f* and 44*f* were placed on opposing sides of a 5 inch diameter center blade 42*f*, and all blades mounted on a common drive shaft. As the cutting segments 42*f*, 43*f*, and 44*f* were only about 0.25 inch high in the radial direction, the shoulder cutting segments 43*f* and 44*f* abutted the metal support disc 34*f* of the center blade, with about a 0.25 inch length of support disc 34*f* exposed between the radially exterior edge of the shoulders 43*f* and 44*f* and the radially inner edge of the center cutting segment 42*f*.

Referring to FIG. 15, after the first few cuts on uncured concrete all corners were rounded. The blade was used until the center cutting segment 42*g* was almost undercut. Although the center segment 42*g* maintained a generally rectangular cross-sectional shape, with rounded edges, it was almost undercut as the exposed portion of the support 34*g* wore away. The shoulder or side cutting segments 43*g*, 44*g* maintained a generally rectangular cross-sectional shape, but with a gradual convex curve from the interior juncture 47*g* toward the exterior edge of the side segments 43*g* and 44*g*.

The cutting segments 40*g* also formed a wedge shape along the peripheral length of each of the segments. The axial width of the circumferential leading end of each of the segments 43*g*, and 44*g*, was about 1/32 of an inch smaller than the axial width of the circumferential trailing end of the segments. The leading end of the central segment 42*g* was about 40% smaller in axial width than the trailing end when the test was stopped. The circumferential leading end of each of the side or shoulder cutting segments 43*g*, 44*g* was about 20% smaller in axial width than the circumferential trailing end at the end of the test.

When tested on an uncured concrete slab about 31 foot long, the blade configuration of FIG. 14 had a fairly constant cutting speed of about 8.7 feet per minute. That is close to three times the cutting rate of the rectangular blade of FIG. 4. However, this blade configuration did make it noticeably more difficult to push the saw across the concrete while maintaining the desired depth of cut. The extended length of the central portion 42*f*, 42*g* above the shoulders 43*f*, 43*g*, 44*f*, and 44*g* does indicate that a longer central cutting segment causes the blade 40*f*, 40*g* to cut faster, and at a fairly uniform rate.

Figure 16:
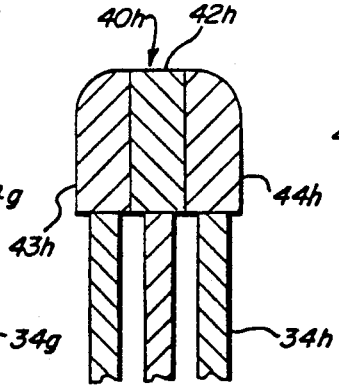
FIG. 16 is a partial sectional view showing the cross-sectional shape of a cutting segment with rounded edges.

Referring to FIG. 16, at the other extreme, a blade 42*h* with a very short center cutting segment also seems to work. Two shoulder blades were used with an extended center blade until the shoulder blades had rounded. The rounded shoulder blades 43*g* and 44*g* were then placed on opposite sides of a substantially rectangular central blade 42*g*. The center blade 42*g* wore until its diameter was the same as the maximum diameter of the abutting shoulder blades 43*g* and 44*g*. It was expected that during use this blade would wear into a rectangular shape. Instead, after use it wore into the inverted "T" configuration.

Figure 17:
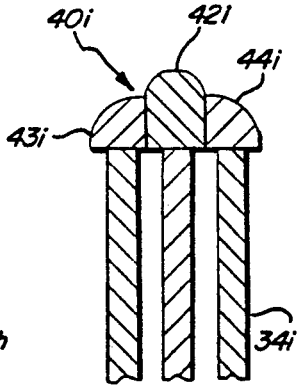
FIG. 17 is a partial sectional view showing the cross-sectional shape of the cutting segment of FIG. 16 after use.

Referring to FIG. 17, after use, the side segments 43*i* and 44*i* maintained their same general shape curving radially inward from the side abutting the center segment 42*i* toward the exterior sides of the segments 43*i* and 44*i*. The diameter wore down so the central segment 42*i* extended above the side segments 43*i* and 44*i* by about 0.1 to 0.125 inches. The corners of the center cutting segment 42*i* rounded to form a convex, dome shaped cross-section angled outward at about a 45 degree angle out of the rotating plane of the blade 38*i*.

Each segment assumed a generally wedged shaped configuration. The circumferential leading end of the center cutting segment 42*i* becoming about 1/32 of an inch narrower than the trailing end, which amounted to about a 40% increase in axial width from the leading end to the trailing end. On the sides or shoulder cutting blades 43*i*, 44*i*, the axial width at the cutting end of each segment was about 1/64 of an inch less than the trailing end. Thus, the circumferential leading end of each side cutting segment 43*i*,, 44*i*, was about 20% narrower than the circumferential trailing end.

The central and side blades 42*i*, 43*i*, and 44*i*, respectively, were also about 1/64 of an inch lower in height at the cutting end than at the leading end over a peripheral segment length of about 1.25 inches, which amounts to about a 0.7 degree taper. Thus, the cutting end of each cutting segment 40*i* was narrower in axial width, and shorter in height, than the trailing end: it had a wedge shape along both its axial width and its height.

The blade configuration of FIG. 17 had an average cutting rate of about 7.7 feet per minute. That is about 2.7 times faster than the rectangular shaped cutting blade of FIG. 4.

Figure 25:
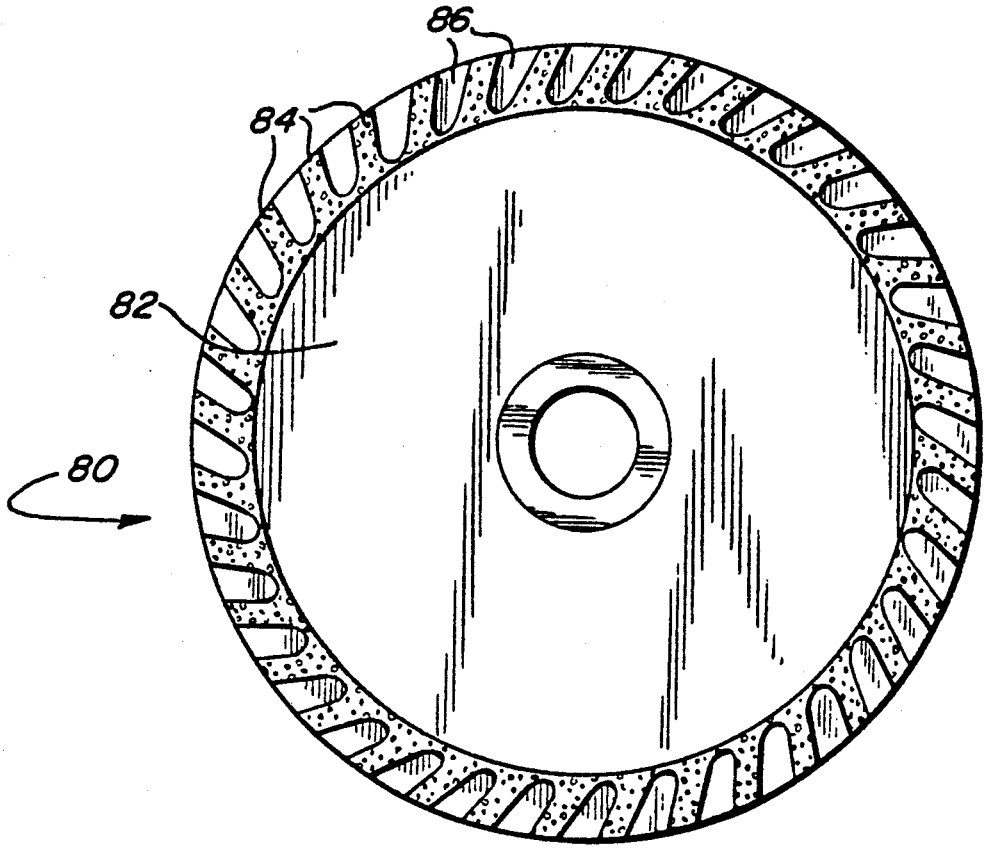
FIG. 25 is a side plan view of a prior art concrete saw blade.
Figure 26:
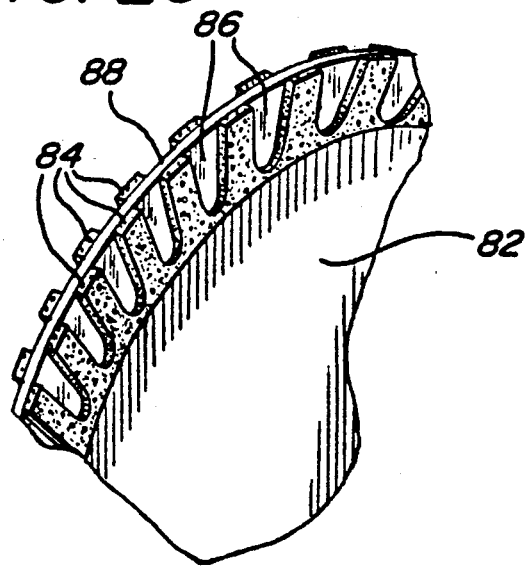
FIG. 26 is a partial sectional view of the concrete saw blade of FIG. 25.

The blades of FIGS. 3–17 are shown as having segments 40 which are separated by outwardly extending slots 37 (FIG. 3) which extend all the way through the axial thickness of the support disc 34 and separate the segments 40. FIGS. 25 and 26 show a "continuous rim" prior art blade design in which the slots 37 do not extend all the way through the support disc 82 or the cutting segments.

A cutting blade 80 has a circular support disc 82 around the periphery of which are circumferentially spaced a plurality of angled cutting projections 84. Slots 86 separate the cutting projections 84. The projections 84 and slots 86 extend outwardly from the rotational axis of the blade 80, but not in a purely radial direction. The projections 84 and slots 86 are curved in the direction of rotation of the blade 80. The projections 84 extend axially outward from a central cutting rim 88 which extends continuously around the periphery of support 32. The slots 86 do not extend through the rim 88. The projections 84 are staggered so they alternate around the periphery of the rim 88, such that a projection 84 on one side of the rim 88 is opposite a space 86 on the other side of the rim 88.

In the cutting blade 80 of FIGS. 25 and 26, the cutting segments are comprised of the projections 84, the slots 86, and the rim 88, all of which are of a diamond-metal matrix. The inverted "T" configuration of the blades of FIGS. 7–10, and 12–17 are believed to work satisfactorily when the segments are not entirely separated by slots extending through the axial width of the blades, as shown in FIGS. 25 and 26.

Indeed, when several individual blades were placed together to form an inverted "T" blade configuration of FIGS. 8–10, and 14–17, the slots 37 of the blades 38 did not always align after use, as the blades 38 would rotate relative to each other about the rotational axis. Thus, it is not essential that the slots 37, 86 extend all the way through the blades 38*a*–38*i*, and 80.

It is believed possible to use cutting blades with no slots, if the concrete 22 (FIG. 1) is hard enough. Thus, the saw blades of this invention may be considered as having cutting surfaces which comprise unsegmented, unslotted abrasive blades for use when the concrete is sufficiently hard, over 1200 psi, and advantageously about 2000 psi. The saw blades may also be considered as having cutting surfaces which comprise discrete segmented cutting surfaces separated by outwardly extending slots which do not extend all the way through the axial thickness of the cutting blade or through the axial thickness of the cutting segment. Finally, and preferably, the saw blades may also be considered as having cutting surfaces which comprise discrete segmented cutting surfaces separated by outwardly extending slots which extend all the way through the axial thickness of the cutting blade and through the axial thickness of the cutting segment.

The blades of FIGS. 8–10, and 14–15 are shown as comprising a series of single blades mounted together on a common shaft so as to abut one another, or rather so the cutting segments 40 abut either the support disc 34 or other cutting segments 4*a*. It is believed preferable to have the cutting segments 42 be formed out of a single piece of cutting material mounted on a single support such as disc 34. This integral forming is shown pictorially at FIGS. 7, 12, and 13.

It is also believed preferable to have the cutting segments 40 be wedge shaped along the axial dimension of the segments, being of smaller axial width at the front or cutting end, and greater axial width at the trailing end. If the ratio's from the tests are followed, the cutting edge of the center cutting segment 42 should be about 40% narrower than the central portion at the trailing edge, and the shoulders 43 and 44 should be about 15–20% narrower than the shoulders at the trailing edge. A slight variation on these figures is believed suitable, so that a 35–45% variation in axial width of the central segment 42 is believe suitable, while an axial width variation of about 10–25% on the side segments 43, 44 is believed suitable.

It is also believed preferable to have the cutting segments 40 be wedge shaped along the height dimension of the segments, being of smaller height at the front or cutting end, and greater height at the trailing end. If the data from the tests are followed, the circumferential leading end of the center cutting segment 42 should taper at an angle of about 0.7 degrees toward the trailing end around the periphery of the circular blade 38. A variation of about 0.6 to 0.8 degrees is believed suitable.

The tests described above varied the height of the center cutting segment 42 above the side or shoulder cutting segments 43 and 44 by as little as a fraction of an inch, to as much as 0.5 inch (1.27 cm.). That amounts to a height differential between the radial outer periphery of the center segments 42, from the side segments 43, 44, which is about 2 times the axial width of the composite blade segment 40.

For cutting a contraction groove in addition to cutting a narrower crack control groove, it is advantageous to have the center segment 42 extend a distance into the concrete 22 which corresponds to the largest aggregate size in the cement. Of course the aggregate size varies depending on the nature of the use for the concrete. The aggregate sizes most commonly used are 0.75 inch and 1 inch aggregate, although sometimes 1.5 inch aggregate can be used. In these cases, the center segment 42 would extend radially outward from the juncture of the shoulder segments 43 and 44 enough to cut through the largest sized aggregate. The actual extension of the center segment 42 radially outward from the side segments 43, 44 depends on the depth needed for the contraction groove, the amount of wear of the blade, and the amount needed to account for the float of the blade.

One alternate approach is to cut most of the way through the aggregate but not all of the way through, expecting the aggregate to crack the rest of the way as the concrete shrinks during curing. For the aggregate sizes as described above, it is believed advantageous to have the 30 center blade 42 extend beyond the shoulder blades 43 and 44 by about 0.25 inches, 0.5 inches, and 1.0 inches respectively, for this type of alternate approach. The extension could be less depending on how much variation is allowed for movement of the blade 38, and the depth needed for the groove which is to form the sealant well.

For cutting primarily just a sealant well 72 (FIG. 23), or for cutting primarily a contraction joint, it is believed advantageous to have the height of the center cutting segment 42 extend between about 1/16 of an inch (about 0.05 in.) and 0.2 inches above the juncture with the side cutting segments 43 and 44. For cutting a sealant well in combination with a crack control groove for the most common dimensions, it is believed advantageous to have the center cutting segment 42 extend between about 0.2 and 0.5 inches above the juncture with the shoulder cutting segments 43 and 44. For these latter grooves 30, a diameter on the center segments 42 of about 5.0 inches, with a diameter of the side segments 43, 44 of about 4 and ⅜ inches (4.3125 in.) is believed most advantageous.

For the saw 11, cutting blades 38 with maximum diameters between 3.5 and 5.5 inches are believed suitable. The 5 inch maximum diameter blade is believed most suitable for cutting concrete containing aggregate of one inch diameter or less. The 5.5 inch maximum diameter blade is believed suitable for cutting concrete containing aggregate with a maximum size of 1.5 inches. Smaller diameter blades also work, but begin to wear out quicker than the larger diameter blades, and cannot cut as deep without taking steps to position the motor 12 (FIG. 1) close to the surface of the concrete 22, or without using a gearbox to offset the motor from the arbor on which the blades 38 are mounted.

It is believed that starting out with cutting segments 40 having square or sharp exterior edges will work, and with use, the cutting segments 40 will assume rounded configurations which cut even better than the sharp cornered configurations. It is believed most advantageous to start with a configuration of a cutting segment 40 which has rounded exterior edges. It is believed most advantageous to start with a cutting segment 40 having a contoured juncture between the shoulder segments 43 and 44 and the center segment 42.

It is believed advantageous to start with cutting segments 40 having a uniform axial width and height along the periphery of each cutting segment. It is believed that with use, the cutting segments 40 will assume wedge shaped configurations with the axial width of the circumferential leading end being smaller than the axial width of the circumferential trailing end, and that this latter configuration will cut even better than before. Thus, it is believed more advantageous to form the segments 40 with a wedge shape in the axial width of the segments. It is further believed that with use, the cutting segments 40 will wear into wedge shaped configurations with the height of the leading end being smaller than the height of the trailing end, and that this latter configuration will cut even better than before. Thus, it is believed more advantageous to form the segments 40 with a wedge shape in the height of the segments.

It is also believed possible to increase the cutting speed of common narrow blades, having cutting segments with axial widths of about 0.080–0.10 inches, by using the same blade design with the protruding center portion 42 as is used on the inverted "T" shape of the blades 38*a* through 38*i*. Similarly, cutting speeds for cutting wide but deep grooves 30 using the inverted "T" blades of this invention are also believed to be unexpectedly than blades used previously.

Figure 18:
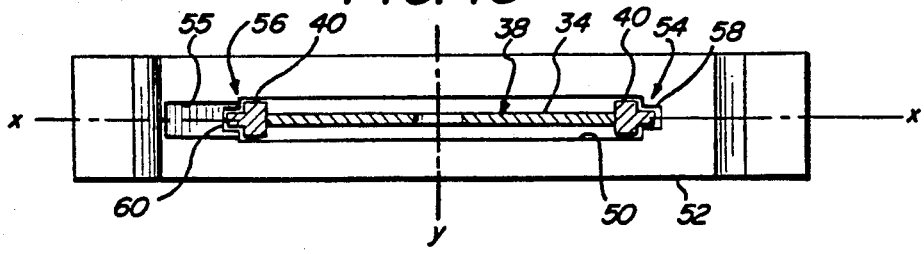
FIG. 18 is a bottom plane view of an embodiment of a skid plate and cutting blade of this invention.

Referring to FIG. 18, the cutting blade 38 passes through a longitudinal slot 50 in a removable skid plate 52. Means for removably fastening the skid plate 52 to the saw 11 (FIG. 1) are known and not described in detail herein. Slot 50 has a leading end 54 located in the direction in which the saw 11 travels, and which is also adjacent the cutting edge of the blade 38. The slot 50 also has a trailing end 56 passing over the groove 30 cut in the concrete by the blade 38, and located opposite the leading end 54. The slot 50 is generally rectangular. A tunnel such as recessed groove 55 is formed in the bottom of the skid plate 52 which abuts the concrete surface 22 (FIG. 1) during cutting so that the trailing end 56 does not trowel over and fill in the recently cut groove 30. Such a recessed groove or a tunnel is described in U.S. Pat. No. 4,903,680, to Chiuminatta, et. al., and application Ser. No. 275,428 filed Nov. 23, 1988 to Chiuminatta, et. al.

The ends 54, 56 of slot 50 are configured to have a shape the same as, but slightly larger than, the cutting segments 40. Thus, for the inverted "T" blade of FIG. 7 with rectangular corners, the leading end 54 has a generally square end with a rectangular, longitudinal slot 58 located at the center of the slot 50, and extending toward the leading end of the skid plate 52.

The width of the slot 50 is selected so that its sides are not more than 0.25 inches from the adjacent and substantially parallel sides of the cutting segments 40. Advantageously, the sides are less than 0.125 inches from the sides of the cutting segments 40, with smaller spacings of 3/32 inch 0.094 in. or 0.23876 cm.), 1/16 inch 0.0625 in. or 0.15875 cm.), and 1/32 inches (0.03125 in. or 0.079375 cm.), each being more advantageous. Preferably, the width of the slot 50 is selected such that the sides of slot 50 are as close as possible to the sides of cutting segment 40, without binding the blade 38.

The width of the slot 58 is selected relative to the central portion 42 of the cutting segment 40, so that the width of slot 40 has the same spacing criteria as described for the width of the slot 50 relative to the sides of the cutting segments 40. The space "b" on FIG. 18 illustrates this clearance between the central segment 42 and the adjacent sides of the slot 58. It is not necessary, however, that the same exact spacing be used on both the width of slots 58 and 50, as one may be wider or narrower than the other, as long as the general spacing criteria is satisfied. If anything, the spacing on the slot 58 is not as important, and may be larger than, the spacing on the sides of the slot 50.

For example, for a blade 38 cutting a 0.25 inch groove for a sealant well, with a 0.90 inch crack control groove, the spacing on the slot 50 might be 3/32 of an inch or less as the appearance of the exterior surface is important, while the spacing on the slot 58 might be 0.125 inches or greater as the appearance on the slot cut by the center segment 42 will not be readily visible to the eye and thus is not as important.

The length of the slot 50 is selected so that its end is not more than about 0.5 inches from the radially outward facing portion of shoulders 43 and 44 of cutting segments 40, with this clearance being indicated by dimension "a" in FIG. 18. Advantageously, this spacing is not more than 0.25 inches, and preferable the spacing is about 0.125. The length of the slot 58 is similarly selected to have dimensions such that the length of slot 58 is not more than 0.5 inches from the radially outward facing end of central portion 42 of the cutting segment 40 as it passes through slot 58. Advantageously, these length dimensions are not more than 0.25 inches, and preferably are about 0.125 inches.

This length dimension of the slots 50, 58 accommodates for the float of the motor 12 and blade 14 as described above. For both slots 50 and 58, if the motion of the cutting segments 40 may be limited or accurately predicted, the spacing between the longitudinal ends of the slots 50, 60 and radial exterior periphery of the cutting segments 40 is preferably as small as possible without binding.

The trailing end 56 has a generally square end with a longitudinal slot 60 extending from the center of slot 50 toward the trailing end of the skid plate 52. The configuration of the trailing end 56 is symmetric to, and has the same dimensional requirements for its width and length as, the leading end 54 of slot 50. Thus the various dimension for length and width of the end 56 and slot 60 will not be repeated. It is possible to have a larger spacing at the leading end than at the trailing end or vice versa, although it is preferable that the spacing be the same at both ends 54, 56.

As the width and length of the slot ends 54, 60 and slots 58, 60 vary with the corresponding dimension of the cutting segments 40, the slots will have the same general dimensions as described above relative to the cutting segments 40, so long as a circular blade 38 can fit through the slot 50 and not bind during cutting. An example of the blade having to fit through the slot 50 would be the blade shown in FIG. 14, in which the slots 58, 60 would have a width based on the width of the larger cutting segment 42 rather than being based on the thickness of the support disc 34. If the width of slots 58, 60 were that of the smaller dimension of the disc 34, then the larger cutting segment 42 around the entire periphery of circular disc 34 would not fit through the narrower width. The blade 38 could not be inserted into the slots. Thus for blades 38 having a cutting segment 40 with a width larger than the comparable dimension of the support 34, the slot must be wide enough to accommodate the largest dimension of the cutting segments 40.

For blades 38 where the center segment 42 extends radially outward from the juncture of the shoulder segments 43 and 44 by as much as .75, 1.0, and 1.5 inches respectively, the corresponding length of the slots 62 would be the same plus an amount to accommodate for the movement of the motor and blade. For the 5 inch blade of the illustrated embodiment, this amounts to as much as 0.5 inch, which results in slot lengths of 1.25, 1.75, and 2.0 inches respectively for the previously listed dimensions. Advantageously these lengths are based on length clearances of 0.25 inches instead of 0.5 inches. More advantageously the lengths are based on clearances of 0.125 inches, which results in slot lengths of 0.875, 1.125, and 1.625 inches for the above listed dimensions. Other dimensions would vary similarly, but the detailed numbers will not be computed.

Figure 19:
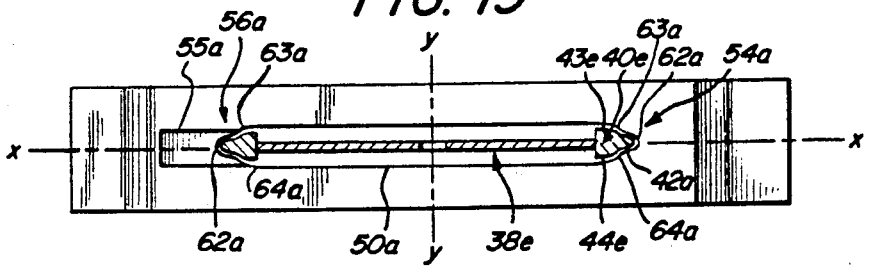
FIG. 19 is a bottom plan view of an embodiment of a skid plate and cutting blade of this invention.

Depending on the configuration of the cutting segments 40, the configuration of the ends 54, 56, and the slots 58, 60, may assume a configuration formed by other than straight lines. An illustrative example is shown in FIG. 19 where a cutting segment as generally shown in FIG. 13 is depicted on a blade **38*e* in which the diameter of the central portion 42*e* is about 5 inches. Thus, the skid plate 52*a* has the ends 54*a*, 56*a* of slot 50*a* with curved shoulders 63*a* and 64*a* on opposite sides of a central slot 62*a*. The juncture between shoulders 64*a* and central slot 62*a* is curved. The curves 62*a*, 64*a*, and have the same shape as, but are configured to be spaced slightly apart from, the corresponding curved segments 42*e*, 43*e*, and 44*e*, respectively as shown on cutting segment 40*e* of FIG. 13**.

For curved cutting segments like those shown in FIGS. 9, 10, 12, 13, and 17, the appropriate spacing between the cutting segments and the adjacent sides of the slot may be determined by using the longitudinal and lateral components of the distance from a point on the curved surface of the cutting segment 40, to the corresponding point on the adjacent ends 54 or 56, or the adjacent slots 50, 58 or 60. The longitudinal axis "X" is the axis along the length of the slot 40. The lateral axis "Y" is the axis perpendicular to the longitudinal axis in the plane of the concrete 22. For the longitudinal component, the spacing on the ends of the slots 50, 58, 60 may be used. For the lateral component, the spacing on the sides of the slots 50, 58, 60 may be used.

If the actual movement of the blade 38 during cutting is known or may be determined, the spacing between the curved portions of the cutting segments 40 and the adjacent curved sides of the slot **54*e* and 62*e* may advantageously use the same criteria as for the distance on the sides of the cutting segment 40, namely to be less than 0.125 inches, more advantageously to be less than 0.0625, and preferably to be as close as possible. However, since it is hard to precisely determine the movement of the blade 38** during cutting, the longitudinal and lateral components may be used as discussed above.

Figure 20:
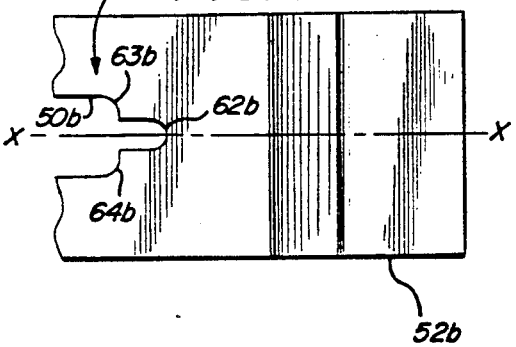
FIG. 20 is a partial bottom plan view of an embodiment of a skid plate of this invention.

In a similar manner, the skid plate 50 may have slot end 54*b* having the shape shown in FIG. 20, which shape corresponds to the shape of blade 38*d*, with cutting segments 40*d* as shown in FIG. 12. FIG. 20 shows skid concave recesses joined together and joined to the sides of the slot 50*b*. Shoulder recesses 63*b* and 64*b* join opposing sides of the slots 50*b* at the leading end 54*b*. The opposite ends of recesses 63*b* and 64*b* join the concave recess 62*b* which is advantageously centered on the longitudinal axis of the slot 50*b*. In FIG. 20, the juncture between the ends of recesses 63*b* and 64*b* with the recess 62*b* forms a square or an acute projection which extends into the slot 50*b*. The recesses 62*b*, 63*b*, and 64*b* are symmetrically positioned relative to the longitudinal axis X of the slot 50*b*.

The width of the various portions of the slot ends 54*b* are within 0.25 inches, are advantageously within 0.125 inches, more advantageously within 0.0625 inches, and are preferably as close as possible to the sides of the cutting segments 40 (FIG. 12) fitting within the slot ends without causing binding. The length or longitudinal dimension of the slot end 54*b* is not more than 0.5 inches, advantageously not more than 0.25 inches, and preferably about 0.125 inches from the radial facing cutting surfaces of the cutting segments 40 (FIG. 12) which fit within the slot ends.

There is a similar trailing end 56*b* which is not shown or described as it is identical in construction to the leading end 56*b*.

Figure 21:
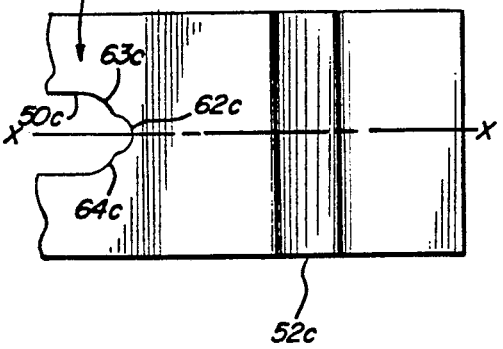
FIG. 21 is a partial bottom plan view of an embodiment of a skid plate of this invention.

Referring to FIG. 21, a similar leading end 56*c* of skid plate 52*c* is shown which has concave recesses 63*c*, 64*c*, and 62*c* joined as described with respect to FIG. 20, and which has dimensions as described with respect to FIG. 20. The details will not be repeated other than to note the following differences. The skid plate 52*c* is configured for use with the blade 38*i* of FIG. 17. The juncture between the ends of recesses 63*c* and 64*c* with the recess 62*c* form an obtusely angled, projection which extends into the slot 50*c*. As with the construction of FIG. 20, the recesses 62*c*, 64*c* are symmetrically positioned relative to the longitudinal axis X of the slot 50*c*. There is a similar trailing end 56*c* which is not shown or described as it is identical in construction to the leading end 56*c*.

Figure 22:
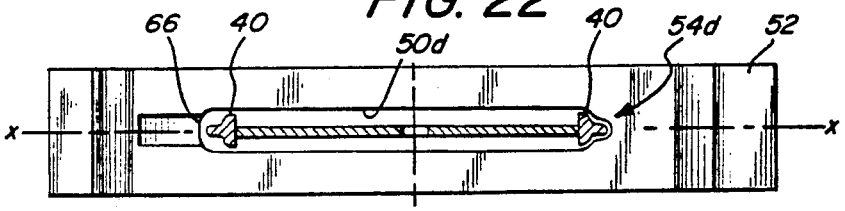
FIG. 22 is a side plan view of an alternate embodiment of a blade and skid plate of this invention on a water lubricated concrete saw.

In the above embodiments, both the leading and trailing ends 54, 56 of the slot 50 had correspondingly shaped ends. In an alternate embodiment shown in FIG. 22, only the leading end 54 of the slot 50*d* has a configured, multi-surfaced shape as described above, while the trailing end has a width sized to fit within the predefined distance of the sides of the cutting segments 40. Other than the specified dimensional fit on the sides, the remainder of the end of the slot 50*d* may assume any desired shape. For illustration, the trailing end is shown with a rounded trailing end 66.

Referring to FIGS. 2 and 18, in use, the blade 38 extends through the slot 50 to cut the concrete 22. The cutting blade 38 is advantageously used soon after the concrete surface 22 is finished to whatever surface finish is desired. As time passes, the concrete cures and becomes progressively harder, with the rate of hardening depending on the temperature, moisture in the air, and on the makeup of the concrete mixture which was poured.

The concrete 22 is most advantageously cut by the above apparatus just after it has been finished, and preferably before any cracks have began to form. The concrete 22 may be cut by the above apparatus before it has reached a hardness of 1200 psi as measured by a Swiss hammer, although cutting at about 2000 psi is also believed to be feasible. The concrete 22 is believed to be suitable for cutting by the above method and apparatus without lubrication as there believed to be sufficient moisture in the concrete at the preferred cutting hardness to prevent the blade 38 from overheating during prolonged cutting.

Figure 23:
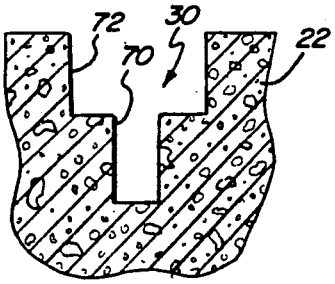
FIG. 23 is a sectional view of a groove cut by a saw of this invention.

Referring to FIGS. 7 and 23, the use of the blades 38, and 38*a*–38*i* described above which have a generally inverted "T" shaped cross-sectional shape, produce a correspondingly shaped groove 30 having a "T" shaped cross-sectional configuration, as shown generally in FIG. 23. The grooves 30 comprise a crack control groove 70 located in the bottom of a wider groove 72 which forms a well for sealant.

The sharpness of the corners on the "T" shaped groove vary with the shape of the shoulder cutting segments 43, 43*a*–43*i*,, 44, and 44*a*–44*i*. The depth and shape of the groove 70, reflecting the length of the stem of the "T", varies with the length and shape of the central cutting segment 42, and 42*a*–42*i*. The stem of the "T" or depth of the groove 70 is advantageously sufficient to form a sufficiently deep groove for crack control. Advantageously the top of the "T" is sufficient to form a groove 72 deep enough and wide enough to allow a sealant to be placed therein and seal the groove 50 from the entrance of moisture as the concrete 22 expands and contracts with climatic variations.

As most current sealant manufactures prefer square segments, it is believed that a groove 72 0.25 inches wide and at least 0.25 inches deep is suitable, although a 0.375 wide groove 72 at least as deep is also likely to be used.

The blades 38 producing these grooves will have segments 40 with axial widths of about 0.25 inches and 0.375 inches, respectively. The depth of the crack control groove 70, and the corresponding length of the central cutting segment 42 above the side cutting segments 43, 44, will vary depending on the size of the aggregate.

The use of the blades 38 described above allows a thinner blade to be used for cutting the deeper, crack control portion 70 of the groove 30, while simultaneously allowing the use of another blade to form a wider, well portion 72 of the groove 30 to contain sealant. The simultaneous formation of both grooves by one blade 38 in the concrete 22 before it cracks provides unexpected advantages not only in reduction of labor and cost, but also in the time required to form the grooves. No heavy water saws are required to be transported or used, no water hookups are needed, cleanup is minimized.

The finishing standards for concrete are partially described in the American Concrete Institute Materials Journal, which specifies cutting grooves in concrete at having a depth at least a quarter of the thickness of the concrete, and describes a suitable finish on a groove 30 as when "the edges of the cut do not ravel." The groove should not be cracked, chipped, or spalled. Grooves 30 formed by using the above method and apparatus meet and exceed these finish requirements; the grooves are of superior quality and finish. The ability to cut the grooves before the concrete has began to crack allow shallower depth cuts to be successfully used.

When cutting uncured concrete, saw's skid plate or a saw blade may deform the surface of the concrete and leave small ridges adjacent the cut groove 30. As the ridges extend above the surface of the concrete 22 when it has hardened. the ridges are contacted by vehicles, wheels, footsteps or other objects traveling over the surface of the concrete. The ridges then brake, spalling the groove 30, and producing an unacceptable surface finish. The surface finish of the groove 30 formed by the above apparatus and method has a smooth finish at its edges, with no ridges.

The saw 11 of this invention is used without any lubricant, and is used to cut the concrete 22 while the concrete still contains enough moisture to prevent the cutting segments from overheating and burning up. As the saw blades 38 rotate at hundreds of revolutions per minute, a lubricant would be picked up by the blade 38 and carried into the groove 30 where it would create high hydraulic pressures which in turn would abrade and erode the shape of the groove 30. Further, the rotating blade 38 would throw the lubricant and any entrained material against the surface of the concrete 22 adjacent the cut groove 30 and cause further unacceptable erosion of the concrete surface. It is only after the concrete hardens sufficiently to prevent this type of erosion that the conventional water lubricated abrasive saws may be used. The saw 11 of this invention cuts before this hardness is reached, and cuts without added lubrication. This hardness is believed to occur at about 1200 psi.

Referring to FIGS. 1 and 2, the saw 11 of this invention is lightweight, weighing under 50 pounds, which enables it to be used on concrete 22 which is not sufficiently hardened to support the weight of the conventional saws which can weigh 900 pounds or more. This lightweight enables cutting the concrete 22 (FIG. 1) before it has cured sufficiently to crack, and this in turn enables the grooves 30 to be more effective. This light weight is made possible in part by using cutting blades of 3.5 to 6 inch diameter which enable the use of a smaller, and-.lighter weight motor 12 (FIG. 1) to drive the blades. The light weight and small size also enable the saw 11 to be transported easily. The saw 11 does not require lubricant, which eliminates the need for providing a water source, and for providing hoses. The cleanup is easier. The saw 11 also enables a crack control joint and a sealant well to be simultaneously cut at rates comparable with the cutting rate of conventional water saws, but without the wait required to cut with conventional water saws.

For example, a 65 horse power, concrete, abrasive water saw might weigh 900 pounds, and use a 12 inch diameter water lubricated abrasive blade to cut a one inch deep and 0.125 inch wide crack control groove at a rate of about 15–20 feet per minute in suitably hardened concrete. A quarter inch wide and one inch deep contraction joint will be cut at a rate of about 8–10 feet per minute by the same saw, but only after the concrete has hardened sufficiently, and that may take several days.

By contrast, using the rectangular cross-section blade of FIG. 4 with a saw 11 and appropriate skid plate 24, and cutting a few hours after the concrete is poured and finished, the cutting rate for a contraction joint about 1 inch deep and about 0.25 inches wide averages 3 feet per minute.

While the rate of cutting with the saw 11 and a rectangular cross-sectional blade of FIG. 4 is 2–3 times slower than the rate for cutting hardened concrete by the conventional water saw, the time, labor, and cost savings of cutting just after the concrete is poured are sufficiently great that there is a great demand for cutting with this blade before the concrete hardens. Unfortunately that blade is not believed suitable for use with hard aggregate, and thus is of limited use.

The apparatus and method of the inverted "T" shaped blades as described above are believed to provide cutting rates of 6–9 feet per minute for contraction joints, in concrete with hard aggregate. That cutting rate compares favorably with the conventional water abrasive saws cutting at 8–10 feet per minute. The cutting blades of this invention do not require the water lubrication of conventional abrasive water saws, do not require the sandblasting as with conventional water saws, and do not create the cleanup problems and logistical problems inherent with the water lubricated saw.

There is thus advantageously provided an apparatus and method for cutting uncured concrete at rates faster than previously available. The design of the saw blades and cutting segments, the design of the skid plate, and the method of cutting by using the saw provide new and advantageous results.

Figure 24:
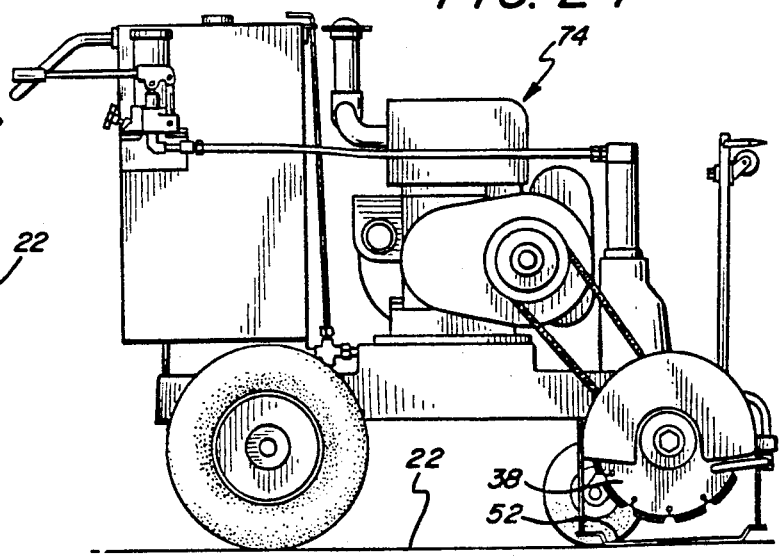
FIG. 24 is a side plan view of a concrete conventional water saw adapted to use a cutting blade and skid plate of this invention.

In an alternate embodiment of this invention, it is believed possible to use the inverted "T" configuration blades of this invention and the appropriate skid plate, in conjunction with a conventional water saw. FIG. 24 shows such a modification. A conventional water saw 74 is fitted with a large diameter blade 38 having an inverted "T" configuration as described above in FIG. 7. The saw 74 is preferably modified to cut in an up-cut rotation, although it is believed possible to use the saw 74 with a down-cut rotation of the blade 38 when the concrete is sufficiently hard as described hereinafter.

The diameter of the blade 38 is now 10–12 inches instead of 3.5–6 inches as with the saw 11. This larger blade 38 is made possible by the larger motor and increased power available with the saw 74. It may be necessary to adjust the amount of overhang by which the shoulder cutting segments 43 and 44 overhang the smaller axial width of the support disc 34. A skid plate 52 is removably attached to the saw 70 such that the blade 38 extends through the slot 50 in the same manner as described above. The same fit tolerances as generally discussed above are applicable, but the larger spacing and tolerance dimensions will tend to produce more satisfactory cuts than those same dimensions would produce on concrete which is less hard.

It is believed that such a modified conventional abrasive saw 74 will be able to simultaneously cut superior quality grooves 30 containing a crack control groove and a sealant well in concrete which is may not be satisfactorily cut by conventional saws and conventional abrasive blades. The modified saw 74 will not be able to cut as soon after the concrete 22 is finished as the saw 11 of this invention because the heavy weight of the saw 74 will unacceptably mark the concrete, and as its water lubrication will cause unacceptable deterioration of the surface of the concrete adjacent the grooves 30 if he concrete is not sufficiently hard.

However, such a saw 72 is believed to be able to produce superior cuts in concrete 22 which has a hardness of about 1200 psi or greater, and preferably at a hardness of about 2,000 psi, with no chipping, spalling, or cracking as occurs when conventional saws are used at that hardness of concrete. Preferably, the concrete 22 is not cut with the saw 74 until the concrete is sufficiently hard so that the water does not cause unacceptable abrasion and erosion of the groove 30 or the surface of the concrete 22 adjacent the groove 30. Of course the disadvantage of this alternate embodiment is that the concrete 22 often cracks before it is hard enough for this heavy saw, and hard enough not to abrade under the hydraulic forces caused by the water lubrication of the blade 38.

While described for use with the blade 38 of FIG. 7, any of the blades and the corresponding skid plates as described above or claimed herein are believed to provide suitable results.

Although exemplary embodiments of this invention have been disclosed for purposes of illustration, it will be understood that various changes, modifications and substitutions may be incorporated in such embodiments without departing from the spirit of the invention as defined by the claims which follow.

I claim:

1. A circular concrete saw blade comprising:

a support disc;

a plurality of circumferentially spaced concrete cutting segments supported about the periphery of the support disc, the cutting segments including a group of central cutting segments located axially between and extending radially outward from two adjacent groups of side cutting segments with the side cutting segments contacting the central cutting segments, wherein the cutting segments have circumferentially leading and trailing ends forming a wedge shape in which the axial width of the leading end is smaller than the axial width of the trailing end.

2. A saw blade as defined in claim 1, wherein the cutting segments are formed by a plurality of outwardly extending slots which extend through the axial width of the support disc.

3. A saw blade as defined in claim 1, wherein the cutting segments are formed by a plurality of outwardly extending slots which extend partially through the axial width of the support disc.

4. A circular saw blade combination for simultaneously cutting an inverted T-shaped groove in a concrete surface, comprising:

a central support disc having a periphery about which are mounted a plurality of central cutting segments having a first axial width and a first radial length extending from an inner radius to an outer radius; and two side supporting disc located on opposite sides of the central support disc with each side supporting disc having a periphery about which are mounted a plurality of side cutting segments having a second radial length extending from an inner radius to an outer radius, with the outer radius of the side cutting segments being at least as great as the inner radius of the central cutting segment but being less than the outer radius of the central cutting segment, so that the side cutting segments abut the central cutting segment and form a generally T-shaped cutting segment.

5. A saw blade as defined in claim 4, wherein the side cutting segments having an axial width that is about the same width as that of the central cutting segments.

6. A saw blade as defined in claim 4 or 5, wherein the axial width of the combined central and side cutting segments is between about 0.2 and 0.4 inches.

7. A saw blade as defined in claim 4 or 5, wherein the side cutting segments have curved exterior corners which contact the concrete.

8. A circular concrete saw blade comprising:

a support disc;

a plurality of circumferentially spaced concrete cutting segments supported about the periphery of the support disc, the cutting segments including a group of central cutting segments located axially between and extending radially outward from two adjacent groups of side cutting segments with the side cutting segments contacting the central cutting segments, wherein the cutting segments have circumferentially leading and trailing ends forming a wedge shape in which the radial height of the leading end is smaller than the radial height of the trailing end.

9. A saw blade as defined in claim 8, wherein the cutting segments are formed by a plurality of outwardly extending slots which extend through the axial width of the support disc.

10. A saw blade as defined in claim 8, wherein the cutting segments are formed by a plurality of outwardly extending slots which extend partially through the axial width of the support disc.

11. A circular concrete saw blade comprising:

a support disc;

a plurality of circumferentially spaced concrete cutting segments supported about the periphery of the support disc, the cutting segments including a group of central cutting segments located axially between and extending radially outward from two adjacent groups of side cutting segments with the side cutting segments contacting the central cutting segments, wherein the cutting segments have leading and trailing ends forming a wedge shape in which the axial width of the trailing end of the central cutting segment is about 35–45% larger than the axial width of the leading end.

12. A saw blade as defined in claim 11, wherein the cutting segments are formed by a plurality of outwardly extending slots which extends through the axial width of the support disc.

13. A saw blade a defined in claim 11, wherein the cutting segments are formed by a plurality of outwardly extending slots which extend partially through the axial width of the support disc.

14. A circular concrete saw blade comprising:

a support disc;

a plurality of circumferentially spaced concrete cutting segments supported about the periphery of the support disc, the cutting segments including a group of central cutting segments located axially between and extending radially outward from two adjacent groups of side cutting segments with the side cutting segments contacting the central cutting segments, wherein there is a curved, concave juncture between the central cutting segment and the side cutting segments.

15. A saw blade as defined in claim 14, wherein the cutting segments are formed by a plurality of outwardly extending slots which extend through the axial width of the support disc.

16. A saw blade as defined in claim 14, wherein the cutting segments are formed by a plurality of outwardly extending slots which extend partially through the axial width of the support disc.

17. A circular concrete cutting blade, comprising:

first cutting means for cutting a first groove in the concrete at a first depth; and second cutting means contacting the first cutting means for cutting a second groove in the concrete, the depth of the second grove being less than the depth of the first groove, the width of the second groove being wider than the width of the first groove, wherein said first and second cutting means comprise a plurality of circumferentially spaced cutting segments supported about the periphery of the cutting blade, the cutting blades segments having leading and trailing ends forming a width shape in which the axial width of the leading end is smaller than the axial width of the trailing end.

18. A circular concrete cutting blade, comprising:

first cutting means for cutting a first groove in the concrete at a first depth; and second cutting means contacting the first cutting means for cutting a second groove in the concrete, the depth of the second groove being less than the depth of the first groove, the width of the second groove being wider than the width of the first groove, wherein the first cutting means is configured to cut the first groove to a depth corresponding to between 0.5 to 1.1 times the size of the maximum aggregate in the concrete, and wherein the depth and width of the second groove is selected to hold a sufficient amount of sealant to maintain the sealant in contact with the sides of the second groove during climatic variations when the sealant is placed in the second groove, and wherein said first and second cutting means comprise a plurality of circumferentially spaced cutting segments supported about the periphery of the cutting blade, the cutting blades segments having leading and trailing ends forming a wedge shape in which the axial width of the leading end is smaller than the axial width of the trailing end.

19. A circular concrete cutting saw blade, comprising:

a support disc having a periphery;

a cutting surface about the periphery of the disc, the cutting surface having a central convex cutting surface, and having side convex cutting surfaces joined to the central cutting surface but located on opposite sides of the central cutting surface and radially inward from the central cutting surface, wherein the juncture between the central cutting surface and each side cutting surface is concave.

20. A circular concrete cutting blade, comprising:

a support disc having a periphery;

a cutting surface about the periphery of the disc, the cutting surface having a central convex cutting surface, and having side convex cutting surfaces joined to the central cutting surface but located on opposite sides of the central cutting surface and radially inward from the central cutting surface, wherein the cutting surfaces have circumferentially leading and trailing ends forming a wedge shape in which the axial width of the leading end is smaller than the axial width of the trailing end.

* * * * *

UNITED STATES PATENT AND TRADEMARK OFFICE

CERTIFICATE OF CORRECTION

PATENT NO. : 5,184,597

DATED : February 9, 1993

INVENTOR(S) : Edward Chiuminatta et al.

It is certified that error appears in the above-indentified patent and that said Letters Patent is hereby corrected as shown below:

In Column 21, Line 4, change "supporting disc" to --supporting discs--;

In Column 22, Line 39, change "saw blade a" to --saw blade as--; and

In Column 23, Line 8, change "forming a width" to --forming a wedge--.

Signed and Sealed this

Tenth Day of June, 1997

Bruce Lehman

*Attest:*

BRUCE LEHMAN

*Attesting Officer*

*Commissioner of Patents and Trademarks*